US005934655A

United States Patent [19]

Mattoon

[11] Patent Number: 5,934,655

[45] Date of Patent: Aug. 10, 1999

[54] BEAM CLAMP

[76] Inventor: Terry L. Mattoon, P.O. Box 265, Phelps, N.Y. 14532

[21] Appl. No.: 09/164,636

[22] Filed: Oct. 1, 1998

[51] Int. Cl.[6] ..... B25B 1/20

[52] U.S. Cl. ..... 269/37

[58] Field of Search ..... 269/37, 249; 248/229.15

[56] References Cited

U.S. PATENT DOCUMENTS

| | | | |
|---|---|---|---|
| 2,896,896 | 7/1959 | Revzin | 248/229.15 |
| 3,170,708 | 2/1965 | Miller | 269/249 |
| 4,787,591 | 11/1988 | Villacorta | 248/316.7 |

*Primary Examiner*—Timothy V. Eley
*Assistant Examiner*—Benjamin Halpern

[57] ABSTRACT

A beam clamp for attachment to a beam structure such as a side flange of an I-beam for suspending threaded hanger rods therefrom for installing plumbing and electrical apparatuses thereon. The beam clamp includes a generally C-shaped clamping member with a spaced apart pair of clamping arms and a connecting portion connecting the clamping arms together. The clamping arms of the clamping member define a space designed for receiving a portion of a beam structure therein. A first of the clamping arms has a threaded axial bore extending therethrough. A threaded bolt is threadably extended through the threaded axial bore of the first clamping arm into the space between the clamping arms of the clamping member. The connecting portion of the clamping member has hole therethrough extending between the first and second faces of the clamping member. A shaft is extended through the hole of the connecting portion. Coupled to either end of the shaft are first and second barrels each with a threaded bore therethrough.

8 Claims, 2 Drawing Sheets

BEAM CLAMP

BACKGROUND OF THE INVENTION

1. Field of the Invention

The present invention relates to beam clamps and more particularly pertains to a new beam clamp for attachment to a beam structure such as a side flange of an I-beam for suspending threaded hanger rods therefrom for installing plumbing and electrical apparatuses thereon.

2. Description of the Prior Art

The use of beam clamps is known in the prior art. More specifically, beam clamps heretofore devised and utilized are known to consist basically of familiar, expected and obvious structural configurations, notwithstanding the myriad of designs encompassed by the crowded prior art which have been developed for the fulfillment of countless objectives and requirements.

Known prior art beam clamps include U.S. Pat. No. 2,896,896; U.S. Pat. No. 4,747,590; U.S. Pat. No. 5,423,525; U.S. Pat. No. 4,074,899; U.S. Pat. No. 4,691,907; and U.S. Pat. No. Des. 378,343.

While these devices fulfill their respective, particular objectives and requirements, the aforementioned patents do not disclose a new beam clamp. The inventive device includes a generally C-shaped clamping member with a spaced apart pair of clamping arms and a connecting portion connecting the clamping arms together. The clamping arms of the clamping member define a space designed for receiving a portion of a beam structure therein. A first of the clamping arms has a threaded axial bore extending therethrough. A threaded bolt is threadably extended through the threaded axial bore of the first clamping arm into the space between the clamping arms of the clamping member. The connecting portion of the clamping member has hole therethrough extending between the first and second faces of the clamping member. A shaft is extended through the hole of the connecting portion. Coupled to either end of the shaft are first and second barrels each with a threaded bore therethrough.

In these respects, the be am clamp according to the present invention substantially departs from the conventional concepts and designs of the prior art, and in so doing provides an apparatus primarily developed for the purpose of attachment to a beam structure such as a side flange of an I-beam for suspending threaded hanger rods therefrom for installing plumbing and electrical apparatuses thereon.

SUMMARY OF THE INVENTION

In view of the foregoing disadvantages inherent in the known types of beam clamps now present in the prior art, the present invention provides a new beam clamp construction wherein the same can be utilized for attachment to a beam structure such as a side flange of an I-beam for suspending threaded hanger rods therefrom for installing plumbing and electrical apparatuses thereon.

The general purpose of the present invention, which will be described subsequently in greater detail, is to provide a new beam clamp apparatus and method which has many of the advantages of the beam clamps mentioned heretofore and many novel features that result in a new beam clamp which is not anticipated, rendered obvious, suggested, or even implied by any of the prior art beam clamps, either alone or in any combination thereof.

To attain this, the present invention generally comprises a generally C-shaped clamping member with a spaced apart pair of clamping arms and a connecting portion connecting the clamping arms together. The clamping arms of the clamping member define a space designed for receiving a portion of a beam structure therein. A first of the clamping arms has a threaded axial bore extending therethrough. A threaded bolt is threadably extended through the threaded axial bore of the first clamping arm into the space between the clamping arms of the clamping member. The connecting portion of the clamping member has hole therethrough extending between the first and second faces of the clamping member. A shaft is extended through the hole of the connecting portion. Coupled to either end of the shaft are first and second barrels each with a threaded bore therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beam clamp apparatus and method which has many of the advantages of the beam clamps mentioned heretofore and many novel features that result in a new beam clamp which is not anticipated, rendered obvious, suggested, or even implied by any of the prior art beam clamps, either alone or in any combination thereof.

It is another object of the present invention to provide a new beam clamp which may be easily and efficiently manufactured and marketed.

It is a further object of the present invention to provide a new beam clamp which is of a durable and reliable construction.

An even further object of the present invention is to provide a new beam clamp which is susceptible of a low cost of manufacture with regard to both materials and labor, and which accordingly is then susceptible of low prices of sale to the consuming public, thereby making such beam clamp economically available to the buying public.

Still yet another object of the present invention is to provide a new beam clamp which provides in the apparatuses and methods of the prior art some of the advantages thereof, while simultaneously overcoming some of the disadvantages normally associated therewith.

Still another object of the present invention is to provide a new beam clamp for attachment to a beam structure such as a side flange of an I-beam for suspending threaded hanger rods therefrom for installing plumbing and electrical apparatuses thereon.

Yet another object of the present invention is to provide a new beam clamp which includes a generally C-shaped clamping member with a spaced apart pair of clamping arms and a connecting portion connecting the clamping arms together. The clamping arms of the clamping member define a space designed for receiving a portion of a beam structure therein. A first of the clamping arms has a threaded axial bore extending therethrough. A threaded bolt is threadably extended through the threaded axial bore of the first clamping arm into the space between the clamping arms of the clamping member. The connecting portion of the clamping member has hole therethrough extending between the first and second faces of the clamping member. A shaft is extended through the hole of the connecting portion. Coupled to either end of the shaft are first and second barrels each with a threaded bore therethrough.

Still yet another object of the present invention is to provide a new beam clamp that may be used to always suspend a hanger rod vertically from an I-beam extending at any angle.

Even still another object of the present invention is to provide a new beam clamp that lets a user use a single type of beam clamp on the job site from suspending hanger rods therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
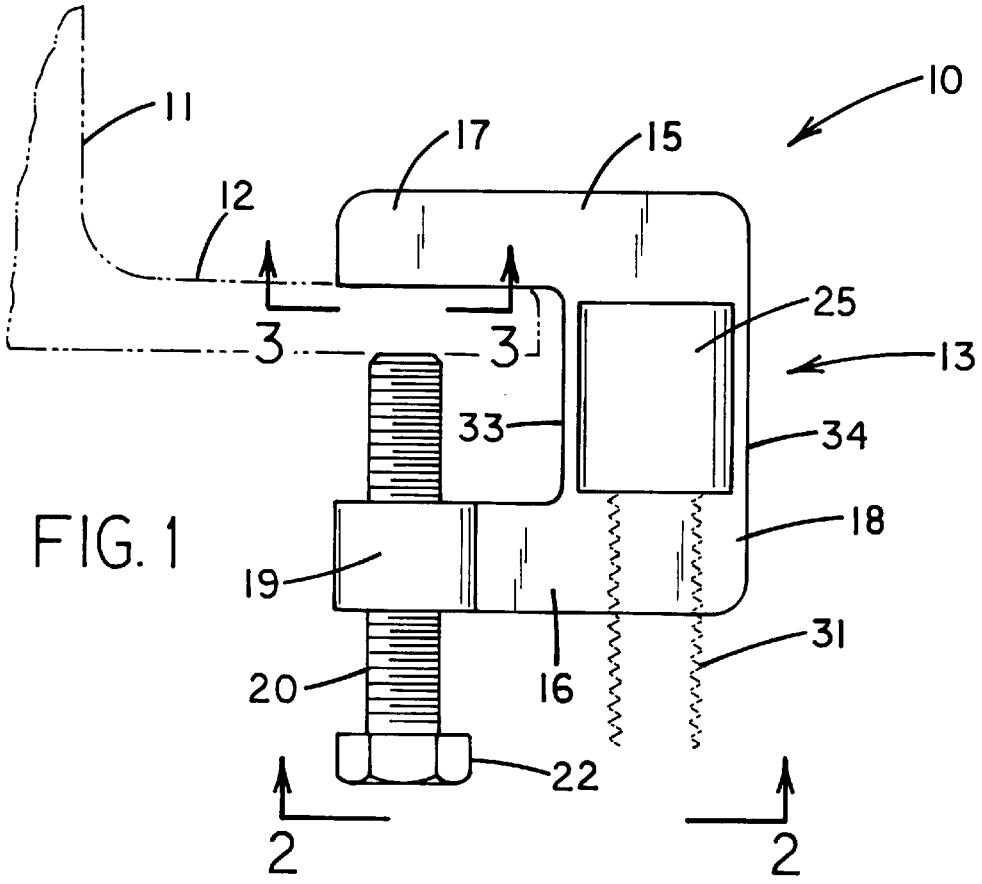
FIG. 1 is a schematic side view of a new beam clamp in use mounted to a beam structure according to the present invention.

With reference now to the drawings, and in particular to FIGS. 1 through 6 thereof, a new beam clamp embodying the principles and concepts of the present invention and generally designated by the reference numeral 10 will be described.

As best illustrated in FIGS. 1 through 6, the beam clamp 10 generally comprises a generally C-shaped clamping member 13 with a spaced apart pair of clamping arms 16,17 and a connecting portion 18 connecting the clamping arms 16,17 together. The clamping arms 16,17 of the clamping member 13 define a space designed for receiving a portion of a beam structure 11 therein. A first of the clamping arms 16 has a threaded axial bore extending therethrough. A threaded bolt 20 is threadably extended through the threaded axial bore of the first clamping arm 16 into the space between the clamping arms 16,17 of the clamping member 13. The connecting portion 18 of the clamping member 13 has hole therethrough extending between the first and second faces 14,15 of the clamping member 13. A shaft 23 is extended through the hole of the connecting portion 18. Coupled to either end of the shaft 23 are first and second barrels 24,25 each with a threaded bore 26,27 therethrough.

In use, the beam clamp 10 is designed for mounting to a beam structure 11 such as a side flange 12 of an I-beam for suspending hanger rods 31 therefrom on which plumbing and electrical conduits and apparatuses may be mounted so that the plumbing and electrical conduits and apparatuses are suspended from the beam structure. Specifically, the beam clamp 10 comprises a generally C-shaped clamping member 13 with first and second faces 14,15, a spaced apart pair of clamping arms 16,17 and a connecting portion 18 connecting the clamping arms 16,17 together. Each of the clamping arms 16,17 terminates at a free end distal the connecting portion 18. The first and second faces 14,15 of the clamping member 13 preferably lie in generally parallel planes to one another. The clamping arms 16,17 and the connecting portion 18 of the clamping member 13 each have a longitudinal axis. In the preferred embodiment, the longitudinal axes of the clamping arms 16,17 are extended generally parallel to one another and generally perpendicular to the longitudinal axis of the connecting portion 18. Ideally, the longitudinal axes of the clamping arms 16,17 and the connecting portion 18 generally lie in a common plane generally parallel to the planes of the first and second faces 14,15 of the clamping member 13.

The clamping arms 16,17 of the clamping member 13 define a generally rectangular space designed for receiving a portion of a beam structure 11 such as a side flange 12 of an I-beam therein. A first of the clamping arms 16 has a generally cylindrical portion 19 at the free end of the first clamping arm 16. The cylindrical portion 19 of the first clamping arm 16 has a center axis extending generally parallel to the longitudinal axis of the connecting portion 18 of the clamping member 13. The cylindrical portion 19 of the first clamping arm 16 has a threaded axial bore extending therethrough along the longitudinal axis of the first clamping arm 16 such that the axial bore is generally coaxial with the longitudinal axis of the first clamping arm 16.

A threaded bolt 20 is threadably extended through the threaded axial bore of the first clamping arm 16 into the space between the clamping arms 16,17 of the clamping member 13. The threaded bolt 20 and a second of the clamping arms 17 is designed for holding a portion of a beam structure 11 in the space between the clamping arms 16,17 therebetween such that the clamping member 13 is clamped to the beam structure 11. Preferably, the second clamping arm 17 has a knurled portion 21 such as ridges or teeth for forming a frictionally enhanced surface with respect to a substantially smooth surface. The knurled portion 21 faces an inner end of the threaded bolt 20. In use, the knurled portion 21 is designed for helping frictionally hold a portion of a beam structure 11 positioned between the second clamping arm 17 and the inner end of the threaded bolt 20. Ideally, the threaded bolt 20 has a hex-shaped head 22 designed for engaging a wrench for aiding the turning of the threaded bolt 20 in the threaded axial bore of the first clamping arm 16.

Figure 2:
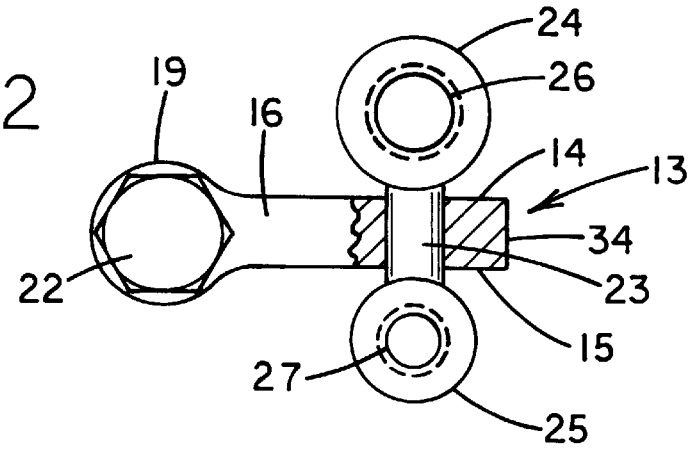
FIG. 2 is a schematic partial cross sectional view of the present invention seen from the vantage of line 2—2 of FIG. 1.
Figure 3:
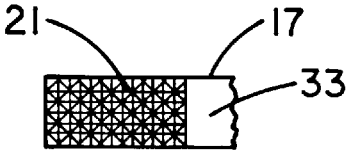
FIG. 3 is a schematic bottom side view of the second clamping arm of the present invention as seen from the vantage of line 3—3 of FIG. 1.
Figure 4:
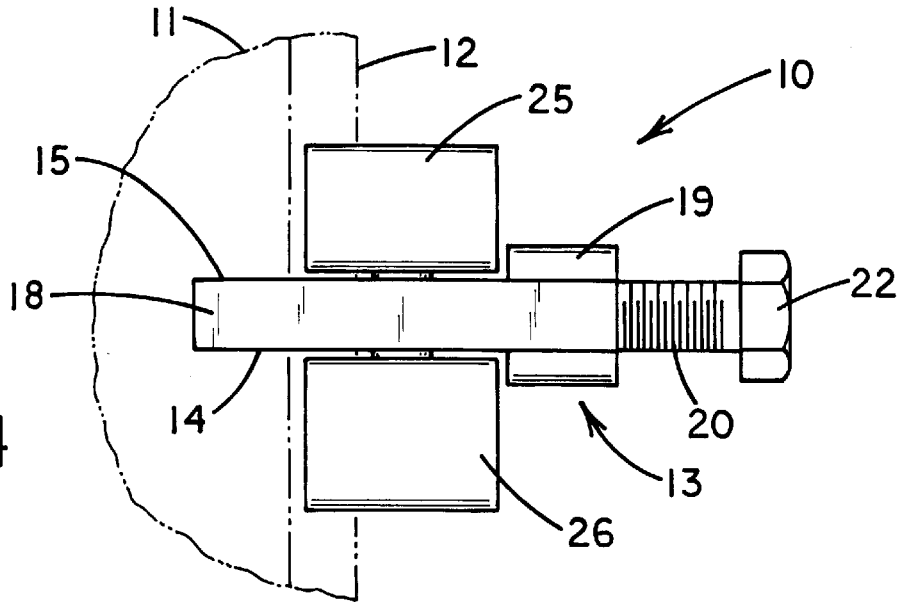
FIG. 4 schematic side view of the present invention mounted to a beam structure.
Figure 5:
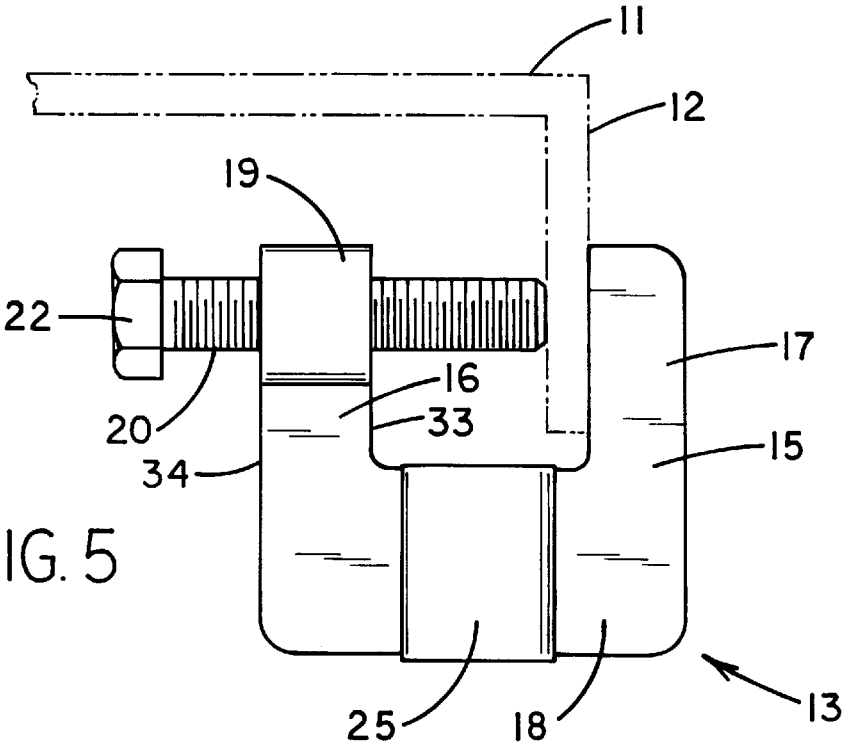
FIG. 5 is a schematic side view of the present invention mounted to a second beam structure illustrating the rotating of the barrels so that the barrels extend vertically in the new orientation.
Figure 6:
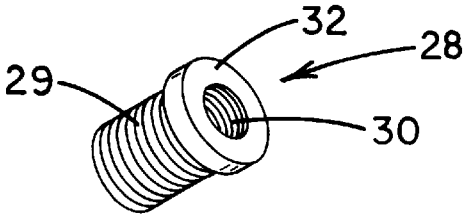
FIG. 6 is a schematic perspective view of an insert of the present invention.

The connecting portion 18 of the clamping member 13 has generally cylindrical hole therethrough extending between the first and second faces 14,15 of the clamping member 13. Preferably, the hole of the connecting portion 18 is located at a midpoint on the connecting portion 18 generally equidistant between the clamping arms 16,17. In the preferred embodiment, the hole of the connecting portion 18 has an axis extending generally perpendicular to the common plane of the longitudinal axes of the clamping arms 16,17 and the connecting portion 18. As illustrated in FIG. 2, a generally cylindrical shaft 23 is extended through the hole of the connecting portion 18 such that a first of the ends of the shaft 23 is outwardly extended from the first face 14 of the clamping member 13 and a second of the ends of the shaft 23 is extended from the second face 15 of the clamping member 13. The shaft 23 has a longitudinal axis extending between the ends of the shaft 23. The shaft 23 is freely rotatable in the hole of the connecting portion 18 about the longitudinal axis of the shaft 23.

The beam clamp 10 also includes first and second barrels 24,25. Each barrel 24,25 is generally circular and has an central axis and a threaded bore 26,27 therethrough coaxial to the center axis of the respective barrel. The first barrel 24 is coupled to the first end of the shaft 23 and the second barrel 25 is coupled to the second end of the shaft 23 such that rotation of the shaft 23 in the hole of the connecting member in turn rotates the first and second barrels 24,25. The center axes of the first and second barrels 24,25 are extended generally perpendicular to the longitudinal axis of the shaft 23 and generally parallel to the planes of the first and second faces 14,15 of the clamping member 13.

In use, the threaded bores 26,27 of the first and second barrels 24,25 each are designed for threadably receiving a threaded hanger rod 31 therein designed for mounting plumbing and electrical conduits and apparatuses thereto to suspend the pluming and electrical conduits and apparatuses from the beam structure 11.

In a preferred embodiment of the beam clamp 10, a generally cylindrical insert 28 is also provided for reducing the diameter of the threaded bore of one of the barrels. The insert 28 has a threaded exterior surface 29 and a threaded aperture 30 therethrough. The insert 28 is threadably inserted into the threaded bore of one of the barrels such that the exterior surface 29 of the insert 28 threadably engages the threaded bore of the one barrel. In use, the threaded aperture 30 of the insert 28 is designed for threadably receiving threaded hanger rods of a smaller diameter than the diameter of the threaded bore of the barrel. Preferably, the insert 28 has an outwardly radiating annular flange 32 at one end of the insert 28. The annular flange 32 abuts one end of the one barrel to prevent the insert 28 from being inserted too far into the threaded bore of the one barrel.

The cylindrical portion 19 has a diameter taken perpendicular to the central axis of the cylindrical portion 19. The clamping member 13 has a thickness defined between the first and second faces 14,15 of the clamping member 13. Preferably, as illustrated in FIG. 2, the diameter of the cylindrical portion 19 is greater than the thickness of the clamping member 13.

In an ideal illustrative embodiment, the threaded bore 26 of the first barrel 24 has a diameter designed for receiving about ½ inch diameter threaded rod 31 therein and the threaded bore 27 of the second barrel 25 has a diameter designed for receiving about ⅜ inch diameter threaded rod 31 therein such that the diameter of the threaded bore 26 of the first barrel 24 is greater than the diameter of the threaded bore 27 of the second barrel 25. In this ideal embodiment, the insert 28 preferably has an outer diameter of about ½ inch and an inner diameter of about ¼ inches so that the insert 28 may is inserted into the threaded bore 26 of the first barrel 24 to let the threaded bore 26 of the first barrel 24 threadably receive ¼ diameter threaded rod 31 therein.

Ideally, the clamping arms 16,17 and the connecting portion 18 each have inner and outer sides 33,34. The inner sides 33 define the space between the clamping arms 16,17 with the inner sides of the clamping arms facing each other. The outer sides 34 are located at a position distal the respective inner side. The clamping arms 16,17 and the connecting portion 18 each have a width defined between the respective inner and outer sides 33,34. Preferably, the widths of the clamping arms 16,17 are about equal to one another and the width of the connecting portion 18 is greater than the width of either of the clamping arms 16,17 for providing optimal structural strength to the clamping member 13.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beam clamp for mounting to a beam structure, comprising:

a generally C-shaped clamping member having a spaced apart pair of clamping arms and a connecting portion connecting said clamping arms together;

said clamping arms of said clamping member defining a space adapted for receiving a portion of a beam structure therein;

a first of said clamping arms having a threaded axial bore extending therethrough;

a threaded bolt being threadably extended through said threaded axial bore of said first clamping arm into said space between said clamping arms of said clamping member;

said threaded bolt and a second of said clamping arms being adapted for holding a portion of a beam structure in said space between said clamping arms therebetween such that said clamping member is clamped to said beam structure;

said connecting portion of said clamping member having hole therethrough;

a shaft having a pair of opposite ends, said shaft being extended through said hole of said connecting portion;

first and second barrels each having a threaded bore therethrough;

said first barrel being coupled to said first end of said shaft, said second barrel being coupled to said second end of said shaft; and said threaded bores of said first and second barrels each being adapted for threadably receiving a threaded rod therein.

2. The beam clamp of claim 1, wherein said clamping member has first and second faces, said first and second faces of said clamping member lying in generally parallel planes to one another.

3. The beam clamp of claim 2, wherein said clamping arms and said connecting portion of said clamping member each have a longitudinal axis, wherein said longitudinal axes of said clamping arms are extended generally parallel to one another and generally perpendicular to said longitudinal axis of said connecting portion, and wherein said longitudinal axes of said clamping arms and said connecting portions generally lie in a common plane generally parallel to said planes of said first and second faces of said clamping member.

4. The beam clamp of claim 1, wherein first clamping arm has a generally cylindrical portion at a free end of said first clamping arm, said threaded axial bore of said first clamping arm being located in said cylindrical portion of said first clamping arm.

5. The beam clamp of claim 1, wherein said second clamping arm has a knurled portion for forming a frictionally enhanced surface with respect to a substantially smooth surface, said knurled portion facing said threaded bolt, said knurled portion being adapted for helping frictionally hold a portion of a beam structure positioned between said second clamping arm and said threaded bolt.

6. The beam clamp of claim 1, further comprising a generally cylindrical insert having a threaded exterior surface and a threaded aperture therethrough, said insert being threadably inserted into said threaded bore of one of said barrels such that said exterior surface of said insert threadably engages said threaded bore of said one barrel.

7. The beam clamp of claim 6, wherein said insert has an outwardly radiating annular flange at one end of said insert, said annular flange abutting said one barrel.

8. A beam clamp for mounting to a beam structure, said beam clamp comprising:

a generally C-shaped clamping member having first and second faces, a spaced apart pair of clamping arms and a connecting portion connecting said clamping arms together, each of said clamping arms terminating at a free end distal said connecting portion;

said first and second faces of said clamping member lying in generally parallel planes to one another;

said clamping arms and said connecting portion of said clamping member each having a longitudinal axis;

said longitudinal axes of said clamping arms being extended generally parallel to one another and generally perpendicular to said longitudinal axis of said connecting portion;

said longitudinal axes of said clamping arms and said connecting portions generally lying in a common plane generally parallel to said planes of said first and second faces of said clamping member;

said clamping arms of said clamping member defining a space adapted for receiving a portion of a beam structure therein;

a first of said clamping arms having a generally cylindrical portion at said free end of said first clamping arm, said cylindrical portion of said first clamping arm having a center axis extending generally parallel to said longitudinal axis of said connecting portion of said clamping member;

said cylindrical portion of said first clamping arm having a threaded axial bore extending therethrough along said longitudinal axis of said first clamping arm;

a threaded bolt being threadably extended through said threaded axial bore of said first clamping arm into said space between said clamping arms of said clamping member;

said threaded bolt and a second of said clamping arms being adapted for holding a portion of a beam structure in said space between said clamping arms therebetween such that said clamping member is clamped to said beam structure;

said second clamping arm having a knurled portion for forming a frictionally enhanced surface with respect to a substantially smooth surface, said knurled portion facing said threaded bolt, said knurled portion being adapted for helping frictionally hold a portion of a beam structure positioned between said second clamping arm and said threaded bolt;

said threaded bolt having a hex-shaped head adapted for engaging a wrench for aiding the turning of said threaded bolt in said threaded axial bore of said first clamping arm;

said connecting portion of said clamping member having generally cylindrical hole therethrough extending between said first and second faces of said clamping member, said hole of said connecting portion being located at a midpoint on said connecting portion generally equidistant between said clamping arms, said hole of said connecting portion having an axis extending generally perpendicular to said common plane of said longitudinal axes of said clamping arms and said connecting portion;

a generally cylindrical shaft having a pair of opposite ends and a longitudinal axis extending between said ends of said shaft, said shaft being extended through said hole of said connecting portion such that a first of said ends of said shaft is outwardly extended from said first face of said clamping member and a second of said ends of said shaft is extended from said second face of said clamping member;

said shaft being rotatable in said hole of said connecting portion about said longitudinal axis of said shaft;

first and second barrels each being generally circular and having an central axis and a threaded bore therethrough coaxial to the center axis of the respective barrel;

said first barrel being coupled to said first end of said shaft, said second barrel being coupled to said second end of said shaft;

said center axes of said first and second barrel being extended generally perpendicular to said longitudinal axis of said shaft and generally parallel to said planes of said first and second faces of said clamping member;

said threaded bores of said first and second barrels each being adapted for threadably receiving a threaded rod therein;

a generally cylindrical insert, having a threaded exterior surface and a threaded aperture therethrough, said insert being threadably inserted into said threaded bore of one of said barrels such that said exterior surface of said insert threadably engages said threaded bore of said one barrel;

said insert having an outwardly radiating annular flange at one end of said insert, said annular flange abutting said one barrel; and said cylindrical portion having a diameter taken perpendicular to said central axis of said cylindrical portion, said clamping member having a thickness defined between said first and second faces of said clamping member, wherein said diameter of said cylindrical portion is greater than said thickness of said clamping member.

* * * * *